US010827779B2

(12) United States Patent
Esposti et al.

(10) Patent No.: US 10,827,779 B2
(45) Date of Patent: Nov. 10, 2020

(54) METHOD FOR MAKING SMOKERS'ARTICLES

(71) Applicant: G.D S.p.A., Bologna (IT)

(72) Inventors: Marco Esposti, Casalecchio di Reno (IT); Ivan Eusepi, Castel Maggiore (IT); Massimo Sartoni, Bologna (IT)

(73) Assignee: G.D S.P.A., Bologna (IT)

( * ) Notice: Subject to any disclaimer, the term of this patent is extended or adjusted under 35 U.S.C. 154(b) by 62 days.

(21) Appl. No.: 14/917,861

(22) PCT Filed: Sep. 24, 2014

(86) PCT No.: PCT/IB2014/064800
§ 371 (c)(1),
(2) Date: Mar. 9, 2016

(87) PCT Pub. No.: WO2015/044877
PCT Pub. Date: Apr. 2, 2015

(65) Prior Publication Data

US 2016/0219927 A1 Aug. 4, 2016

(30) Foreign Application Priority Data

Sep. 25, 2013 (IT) ..... BO2013A0521

(51) Int. Cl.
*A24C 5/47* (2006.01)
*A24D 3/02* (2006.01)
*A24C 5/32* (2006.01)

(52) U.S. Cl.
CPC ..... *A24C 5/47* (2013.01); *A24C 5/32* (2013.01); *A24D 3/0287* (2013.01)

(58) Field of Classification Search
CPC ..... A24C 5/47; A25C 5/32
(Continued)

(56) References Cited

U.S. PATENT DOCUMENTS 3,039,367 A 6/1962 Carl et al.
3,199,418 A * 8/1965 Bernhard ..... A24C 5/478 131/94
(Continued)

FOREIGN PATENT DOCUMENTS

FR 2305942 A1 10/1976
FR 2358845 A1 2/1978
(Continued)

OTHER PUBLICATIONS

English Oxford Living Dictionaries, Definition of Juxtapose, https://en.oxforddictionaries.com/definition/juxtapose.*
(Continued)

*Primary Examiner* — Eric Yaary
*Assistant Examiner* — Russell E Sparks
(74) *Attorney, Agent, or Firm* — Shuttleworth & Ingersoll, PLC; Timothy Klima

(57) ABSTRACT

A method for making smokers' articles by subdividing a semifinished item which includes least five sticks aligned with each other along a main axis, at least two of the sticks are of a type different from the others; the method includes a step of forming the semifinished item by aligning the five sticks in a predetermined succession along the main axis and a step of subdividing a single rod into at least three sticks, followed by a step of aligning along the main axis each of the three sticks obtained from the rod alternating them with each of the sticks of different type, so as to form the semifinished item.

6 Claims, 3 Drawing Sheets

(58) Field of Classification Search
USPC ..... 131/281
See application file for complete search history.

(56) References Cited

U.S. PATENT DOCUMENTS

| | | | | |
|---|---|---|---|---|
| 3,487,754 | A | 1/1970 | Flasdieck et al. | |
| 4,093,496 | A * | 6/1978 | Molins | A24D 3/0287 131/61.1 |
| 4,287,979 | A | 9/1981 | Molins et al. | |
| 2006/0025292 | A1 * | 2/2006 | Hicks | A24D 3/0287 493/39 |
| 2010/0006112 | A1 * | 1/2010 | Yang | A24D 3/04 131/202 |

FOREIGN PATENT DOCUMENTS

| | | | | |
|---|---|---|---|---|
| GB | 2002220 | A | 2/1979 | |
| JP | S51123900 | | 10/1976 | |
| JP | S53015499 | | 2/1978 | |
| JP | H07000165 | | 1/1995 | |
| JP | 2003024035 | A | 1/2003 | |
| JP | 20150515283 | | 5/2015 | |
| WO | WO2011122971 | A2 | 10/2011 | |
| WO | WO-2012164067 | A2 * | 12/2012 | A24C 5/471 |

OTHER PUBLICATIONS

International Search Report and Written Opinion dated Feb. 10, 2015 from counterpart PCT App No. PCT/IB2014/064800.
Italian Search Report dated Jun. 24, 2014 from counterpart Italian App No. BO20130521.
Japanese Search Report dated Apr. 23, 2018 from counterpart Japanese App No. JP2016-516959.

* cited by examiner

METHOD FOR MAKING SMOKERS'ARTICLES

This application is the National Phase of International Application PCT/IB2014/064800 filed Sep. 24, 2014 which designated the U.S. and that International Application was published under PCT Article 21(2) in English.

This application claims priority to Italian Patent Application No. BO2013A000521 filed Sep. 25, 2013.

TECHNICAL FIELD

This invention relates to a method for making smokers' articles.

BACKGROUND ART

More specifically, the smokers' articles referred to are obtained by subdividing a semifinished item defined by at least five sticks which are aligned with each other along a main axis.

More specifically, three of the five sticks are of a different type from the remaining two.

By way of an example and without limiting the scope of the invention, by "different type" is meant that three of the sticks of the semifinished item are preferably of filter material and the other two are of another material.

The five sticks are aligned in a predetermined succession.

In effect, each semifinished item from which two smokers' articles are obtained is cut preferably along a stick of filter material which must then be placed in the central position of the semifinished item itself.

Generally speaking, the stick of filter material to be cut is shorter, along the main axis of the semifinished item, than the other two sticks of filter material.

Also, the two sticks of different type are what are known as products of small size and, along the main axis of the semifinished item, are shorter than the other three sticks of filter material.

Owing to the different lengths of the five sticks, the prior art teaches making a semifinished item by separately feeding the five sticks which have already been cut to size and positioning them relative to each other according to the configuration of the semifinished item.

In other words, to make a semifinished item comprising five sticks, five different feed devices are necessary, making the production of the semifinished product complex in terms of machine system management.

Moreover, manipulating sticks which have already been cut to size is a critical operation since some of the sticks are small in size relative to the main axis of the semifinished item and may thus cause jams while they are being conveyed.

Aim of the Invention

This invention has for an aim to provide a method for making smokers' articles as disclosed herein, to overcome the above mentioned drawbacks.

BRIEF DESCRIPTION OF THE DRAWINGS

The invention is described below with reference to the accompanying drawings, which illustrate a non-limiting embodiment of it and in which.

DETAILED DESCRIPTION OF PREFERRED EMBODIMENTS OF THE INVENTION

Figure 1:
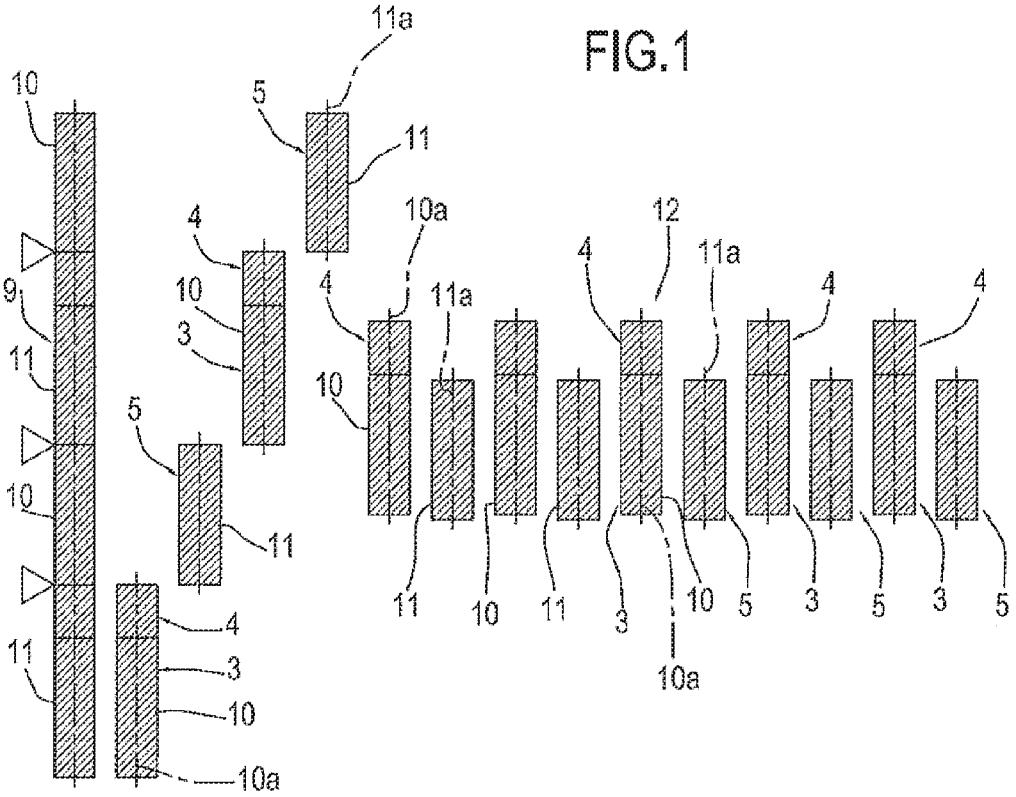
FIG. 1 shows a schematic plan view of a step of subdividing a rod into at least two parts according to a first embodiment for making a cigarette filter stick.

The reference numeral 1 denotes a smokers' article obtained by subdividing a semifinished item 2.

More specifically, two smokers' articles 1 are obtained by cutting one semifinished item 2.

The semifinished item 2 comprises at least five sticks 3, 4, 5, 6, 7 which are aligned with each other along a main axis 2*a*.

At least two 6, 7 of the five sticks are of a different type from the other three 3, 4, 5.

More specifically, in this preferred embodiment, the other three sticks 3, 4, 5 are made of filter material.

The two sticks 6, 7 of different type are made of filter material with additive added or of a flavouring material.

A case where the two sticks 6, 7 of different type from the other three sticks 3, 4, 5 are of a different nature is also imaginable.

The method comprises a step of forming the semifinished item 2 by aligning the five sticks 3, 4, 5, 6, 7 in a predetermined succession 8 along the main axis 2*a*.

Advantageously, the method comprises a step of subdividing a single rod 9 into at least three sticks 3, 4, 5.

By rod 9 is meant a single elongate element extending along a main axis.

Preferably, the transversal cross section of the rod 9 relative to its main axis of extension is circular.

More specifically, the rod 9 is a rod of filter material.

After the step of cutting the rod 9, the method comprises a step of aligning along the axis 2*a* of the semifinished item 2 each of the three sticks 3, 4 and 5 obtained from the rod 9, alternating them with each of the sticks 6, 7 of different type, so as to form the semifinished item 2.

As illustrated in FIG. 1, the step of subdividing the rod 9 comprises a first step of cutting the rod 9 into at least two parts 10, 11, one of which is equal to the sum of at least two sticks 3, 4 and the other is equal to a single stick 5.

Preferably, the rod 9 is subdivided into four parts 10, 11, of which two parts 10 are equal to at least two sticks 3, 4 and the other two parts 11 are equal to a single stick 5.

After cutting the rod 9, the method comprises a step of juxtaposing the at least two parts 10, 11 derived from the subdivision of the rod 9 to form a single row 12 of parts 10, 11 positioned one after the other with their respective main axes of extension 10*a*, 11*a* parallel to each other.

More specifically, the parts 10, 11 in the row 12 are positioned alternately with each other.

Figure 2:
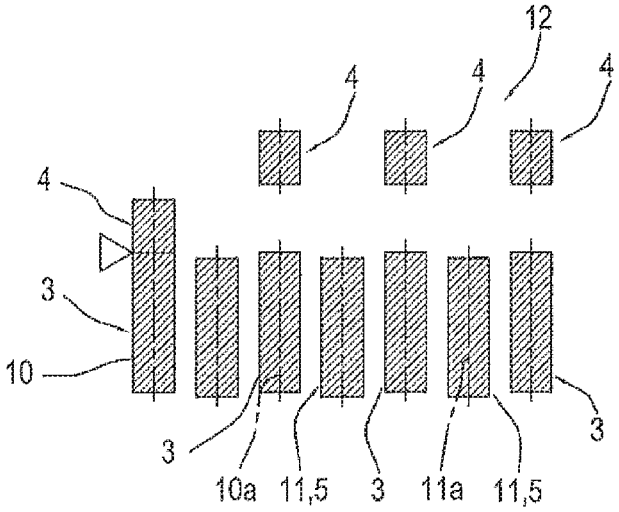
FIG. 2 shows a schematic plan view of a step of cutting a part into a first and a second stick and a step of spacing a second stick from a first stick along a respective main axis of extension according to the first embodiment.

As illustrated in FIG. 2, the method comprises a second step of cutting the part 10, which is equal to the sum of at least two sticks 3, 4, into a first and a second stick 3, 4.

The above mentioned single stick defined by the other part 11 of the rod 9 defines a third stick 5.

In the embodiment illustrated, the second step of cutting the part 10 into a first and a second stick 3, 4 is performed after the step of juxtaposing the two parts 10, 11 derived from the subdivision of the rod 9.

In an alternative embodiment not illustrated, the first step of cutting the rod 9 into at least two parts 10, 11 and the second step of cutting the part 10 into a first and a second stick 3, 4 are performed simultaneously.

In the alternative embodiment not illustrated, the step of juxtaposing the two parts 10, 11 derived from the subdivision of the rod 9 is performed after the second cutting step.

With reference to FIG. 2, the method comprises a step of spacing the second stick 4 from the respective first stick 3 along the respective main axis of extension 10*a*.

Thus, the above mentioned row 12 of parts 10, 11 positioned one after the other is formed by the third stick 5 alternated with the first stick 3 which is spaced from and aligned with the respective second stick 4.

Figure 3:
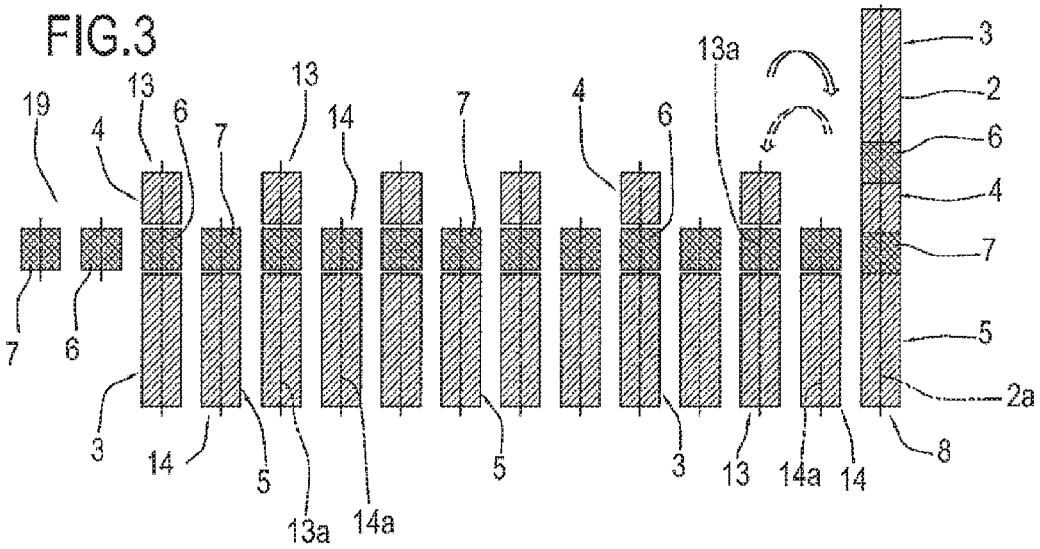
FIG. 3 shows a schematic plan view of a step of feeding a succession of sticks of different type from the other sticks to form a semifinished item according to the first embodiment.

The method comprises a step of feeding at least one succession 19 of sticks 6, 7 of different type from the other, first, second and third sticks 3, 4, 5, as shown in FIG. 3.

The succession 19 of sticks 6, 7 of different type is a single row of sticks 6, 7 positioned one after the other.

The method comprises a step of aligning each stick 6, 7 of different type, alternated with the first stick 3 to form a fourth stick 6 and alternated with the third stick 5 to form a fifth stick 7.

More specifically, the fourth stick 6 is interposed between the first and the second stick 3, 4 to further form a first set 13 of sticks.

The third stick 5 and the fifth stick 7 form a second set 14 of sticks.

The succession 19 of sticks 6, 7 is defined by a fourth stick 6 alternated with a fifth stick 7.

The first and the second set 13, 14 are positioned one after the other with their main axes of extension 13*a*, 14*a* parallel to each other.

Figure 4:
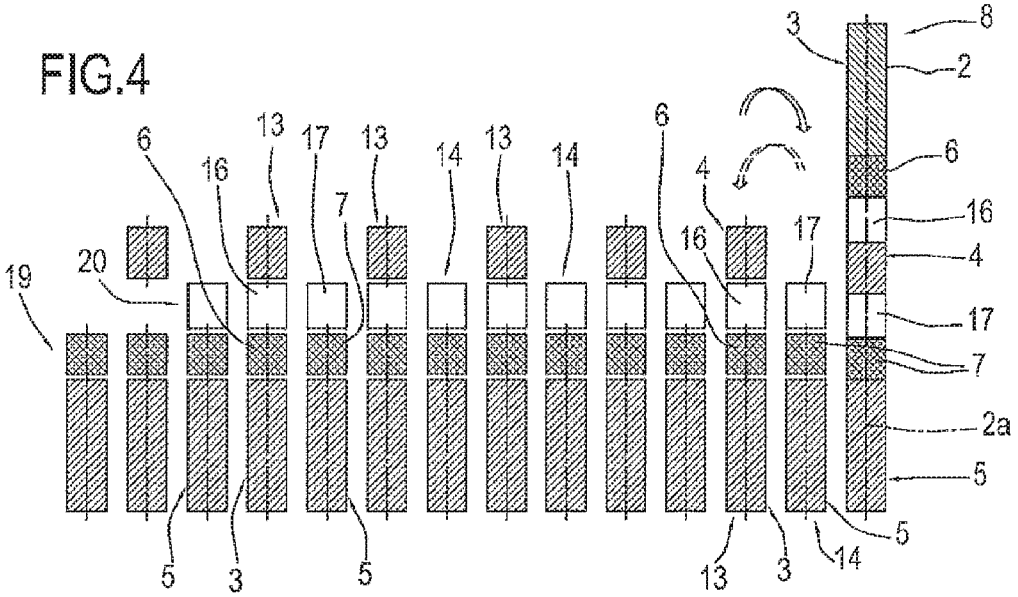
FIG. 4 shows a schematic plan view of a step of feeding two successions of sticks of different type from the other sticks to form a semifinished item according to a second embodiment for making a cigarette filter stick.

FIG. 4 illustrates an embodiment alternative to the one described above and where the method comprises a step of feeding two successions 19, 20 of sticks 6, 7, 16, 17 of different type from the other sticks.

The method comprises a step of aligning each stick 6, 7, 16, 17 of the two sets 13, 14 with the first stick 3 and with the third stick 5.

More specifically, the sticks 6, 16 of the two sets are interposed between and aligned with the first and the second stick 3, 4 to form the first set 13 of sticks.

The sticks 7, 17 of the two sets aligned with the third stick 5 form the second set 14 of sticks.

Figure 5:
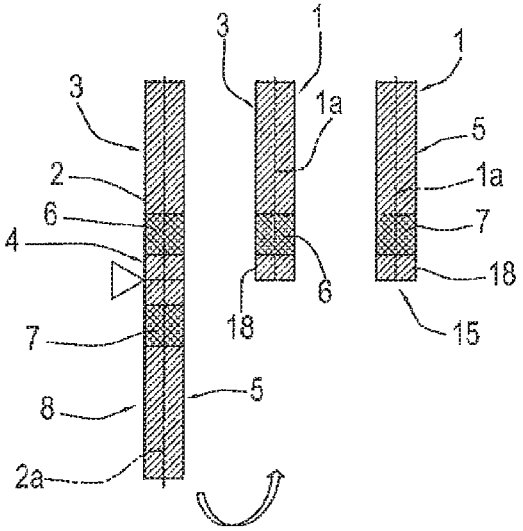
FIG. 5 shows a schematic plan view of a step of subdividing the semifinished item of FIG. 3 into at least two smokers' articles according to the first embodiment.
Figure 6:
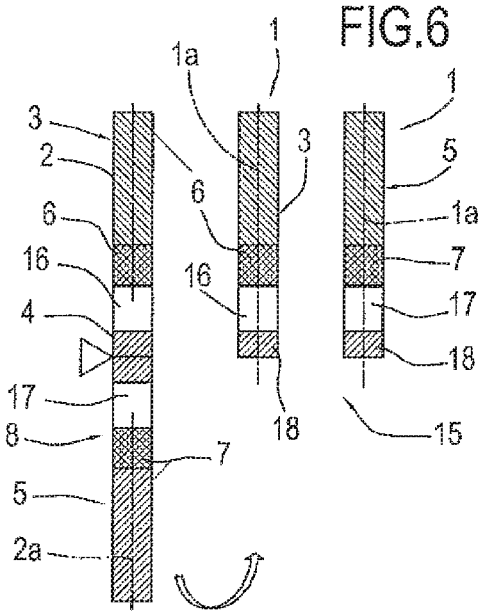
FIG. 6 shows a schematic plan view of a step of subdividing the semifinished item of FIG. 4 into at least two smokers' articles according to the second embodiment.

In order to make the semifinished item 2 illustrated in FIGS. 5 and 6, the method comprises a step of positioning the first and the second set 13, 14 of sticks along the same main axis 2*a*.

More specifically, the step of positioning the first and second sets 13, 14 of sticks along the same main axis 2*a* comprises a step of rotating by at least 180° one of the two sets 13, 14 of sticks relative to the other.

Alternatively, the step of positioning the first and second sets 13, 14 of sticks along the same main axis 2*a* comprises a step of realigning the two sets 13, 14, of sticks with each other.

In the semifinished item 2, the second stick occupies the central position and the first and third sticks 3, 5 occupy the respective end positions.

The fourth and fifth sticks 6, 7 are interposed between the first and the second stick 3, 4 and between the third and the third stick 5, 4, respectively, as illustrated in FIG. 3.

In the alternative embodiment illustrated in FIG. 4, the sticks 6, 7, 16, 17 of different type from the first, second and third sticks 3, 4, 5 are interposed between the first stick 3 and the second stick 4 and between the third stick 5 and the second stick 4.

Once the semifinished item 2 has been made, the method proceeds with a step of subdividing the semifinished item 2 into at least two smokers' articles 1.

Consequently, each smokers' article 1 comprises the first or third stick 3, 5, a half 18 of the second stick 4 and the fourth or fifth stick 6, 7, juxtaposed with the first or third stick 3, 5, respectively, as shown in FIG. 5.

In the alternative embodiment illustrated in FIG. 6, each smokers' article 1 comprises the first or third stick 3, 5, a half 18 of the second stick 4 and the sticks 6, 7, 16, 17 of different type interposed between the first or the third stick 3, 5 and the half 18 of the second stick 4.

Next, the method comprises a step of juxtaposing the smokers' articles 1 to form a single succession 15 of parts 10, 11 positioned one after the other with their main axes 1*a* parallel to each other.

Advantageously, the method for making the smokers' articles according to the invention overcomes the drawbacks of the prior art set out above. In effect, at least three sticks 3, 4, 5 of the semifinished item 2 are derived by cutting a single rod 9, thus avoiding the use of a dedicated feed system for each stick 3, 4, 5.

The invention claimed is:

1. A method for making smoker's articles, comprising: providing a single rod divisible into multiple sticks of a first type; providing at least two sticks of a different type from the first type; the following steps in successive order:

a step of subdividing the single rod into at least three sticks of the first type, comprising a first step of cutting the single rod into at least two parts, a first part of the at least two parts being a combination of at least two sticks of the at least three sticks and a second part of the at least two parts being a single stick of the at least three sticks;

a step of arranging the first and second parts to form a single row of the first and second parts positioned side by side one after another along a common line such that longitudinal axes of the first and second parts are parallel to each other, transverse to the common line and spaced apart from one another along the common line;

a step of forming a semifinished item by aligning at least five sticks in a predetermined succession along a second common line, the predetermined success including alternating the at least three sticks with each of the at least two sticks of the different type to form the semifinished item;

a step of subdividing the semifinished item;

2. The method according to claim 1, wherein the step of subdividing the single rod further comprises a second step of cutting the first part into a first stick and a second stick of the at least two sticks of the at least three sticks with the single stick of the at least three sticks being a third stick of the at least three sticks.

3. The method according to claim 2, and further comprising a step of spacing the second stick from the first stick; the single row of the first and second parts being formed by the third stick alternated with the first stick, the first stick being spaced from and aligned with the second stick.

4. The method according to claim 3, and further comprising a step of feeding at least one succession of the at least two sticks of the different type and a step of aligning each of the at least two sticks of the different type, alternated with the first stick to form at least a fourth stick, and alternated with the third stick to form at least a fifth stick; the fourth stick being interposed between the first stick and the second stick to further form a first set of sticks; the third stick and the fifth stick forming a second set of sticks.

5. The method according to claim 4, wherein the step of forming the semifinished item comprises a step of positioning the first set of sticks and the second set of sticks along the second common line.

6. The method according to claim 5, wherein the step of positioning the first set of sticks and the second set of sticks along the second common line comprises a step of rotating by at least 180° one of the first set of sticks and the second set of sticks relative to the other of the first set of sticks and the second set of sticks.

* * * * *